United States Patent [19]

Pringle

[11] 4,020,512

[45] May 3, 1977

[54] BED ASSEMBLY

[75] Inventor: William L. Pringle, Grosse Pointe Shores, Mich.

[73] Assignee: United States Steel Corporation, Pittsburgh, Pa.

[22] Filed: Sept. 5, 1975

[21] Appl. No.: 610,669

[52] U.S. Cl. ..... 5/264 R; 5/245

[51] Int. Cl.[2] ..... A47C 23/02

[58] Field of Search ..... 5/131, 191, 279 R, 279 B, 5/200 R, 200 B, 200 C, 231, 236, 237, 279 B–279 D, 239, 248, 256, 263–265, 245

[56] References Cited

UNITED STATES PATENTS

| | | | |
|---|---|---|---|
| 795,373 | 7/1905 | Staples | 5/279 B |
| 861,508 | 7/1970 | Franks | 5/279 B |
| 984,823 | 2/1911 | Linden | 5/279 B |
| 2,773,271 | 12/1956 | Wetzler | 5/248 X |
| 3,487,480 | 1/1970 | Slomiski | 5/351 X |

*Primary Examiner*—Paul R. Gilliam
*Assistant Examiner*—Andrew M. Calvert
*Attorney, Agent, or Firm*—McGlynn and Milton

[57] ABSTRACT

A bed assembly comprising a metal frame of generally rectangular configuration including a pair of oppposed side rails and a pair of opposed end rails and a plurality of metal slats extending transversely between the side rails in spaced parallel relationship to one another and to the end rails. Both of the end and side rails have a hollow cross section along their respective lengths. The hollow cross section in each of the rails is defined at least by two metal members welded together. The end rails are defined by a pair of U-shaped members having their legs overlapping with the bases of the U shapes spaced from one another to define the hollow cross section. The side rails are defined by channeled members having a channel extending therealong and a plate-like strip covering the channel to define the hollow cross section. The side rails also include slat support flanges upon which the slats are supported. Each of the slats has a cross section including a base, downwardly extending diverging legs and a flange extending laterally outwardly from the lower end of each leg. Spring retaining apertures are disposed in the bases of the slats and the end rails for engaging and gripping a spring inserted into the aperture. Three tabs extend into each aperture and each aperture is disposed in a concavity for guiding the spring into each aperture.

5 Claims, 8 Drawing Figures

BED ASSEMBLY

The subject invention relates to a bed assembly and more particularly to a box spring assembly of the type for supporting a mattress.

Prior art box spring assemblies have been fabricated from wood and metal, however, the problem with most of the prior art assemblies is that there is not an assembly available which may be economically and easily manufactured yet provide the requisite strength characteristics. Many of the prior art assemblies may allow a high degree of "rack" where one corner may be lifted an unreasonable amount while the remaining three corners remain resting upon a support. Such assemblies typically require support frames when in use.

Additionally, the prior art assemblies typically require special attaching means for attaching springs to the frame. The best known systems for attaching springs to the frame is by stapling the springs to wood slats or specially bending the end of the spring about a component of the box spring assembly.

Another method of anchoring the springs is to insert the spring ends into offset or misaligned apertures in the frame. An example of such are disclosed in U.S. Pat. No. 2,773,271 granted to J. J. Wetzler on Dec. 11, 1956, U.S. Pat. No. 2,135,607 granted to D. C. Travis on Nov. 8, 1938 and U.S. Pat. No. 3,487,480 granted to W. V. Slominski on Jan. 6, 1970.

A bed assembly of the subject invention may be very economically and easily manufactured, yet provides substantial strength when assembled. Such may be accomplished by a bed assembly constructed in accordance with the instant invention having a metal frame of a generally rectangular configuration including a pair of opposed side rails and a pair of opposed end rails with each of the rails having a hollow cross section along their respective lengths. Additionally, the assembly includes metal slats extending between the side rails with spring retaining apertures disposed in the slats and in the end rails for engaging and gripping springs with each of the apertures having tabs extending thereinto and being disposed at the bottom of a concavity whereby a spring is guided into the aperture for retention.

Other advantages of the present invention will be readily appreciated as the same becomes better understood by reference to the following detailed description when considered in connection with the accompanying drawings wherein.

Figure 1:
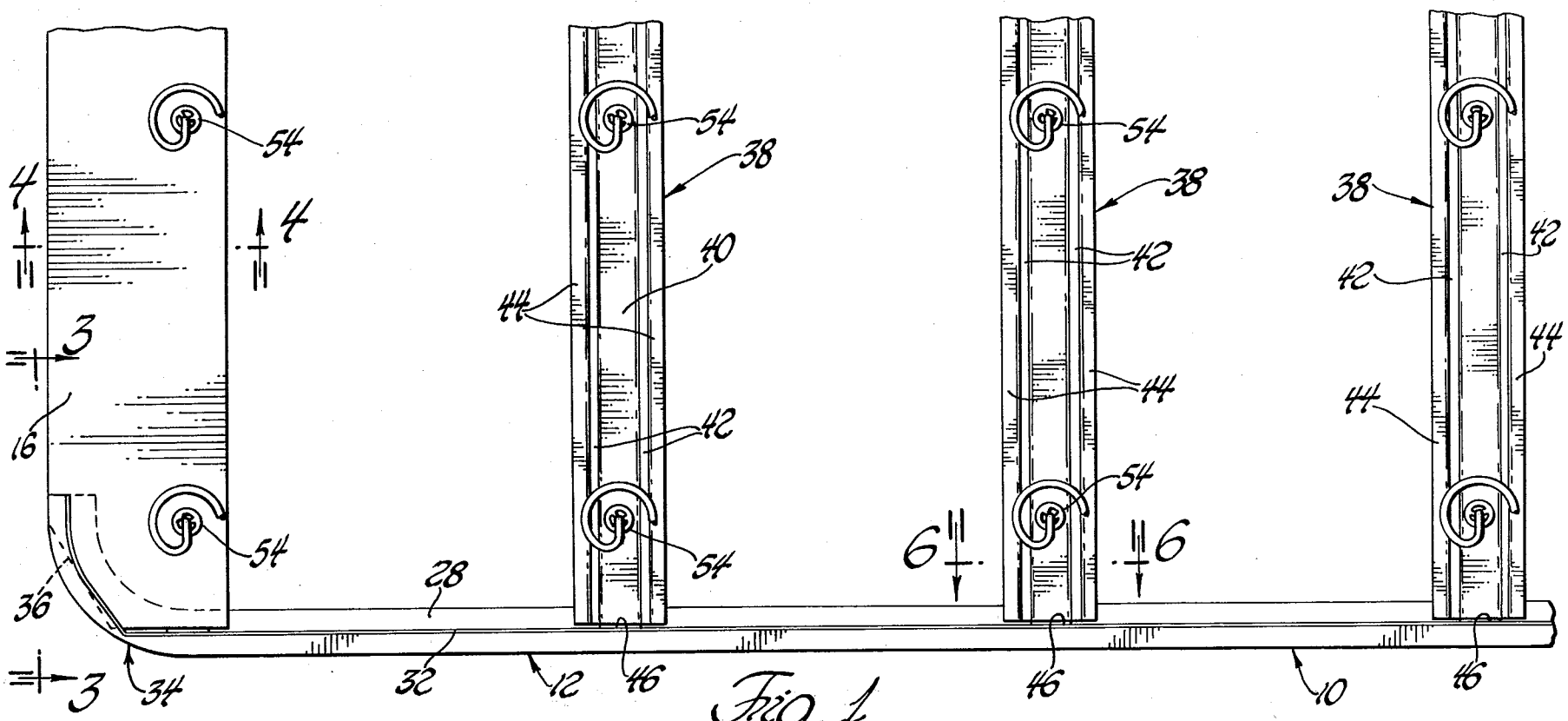
FIG. 1 is a fragmentary plan view showing one corner of a bed assembly constructed in accordance with the subject invention.
Figure 2:
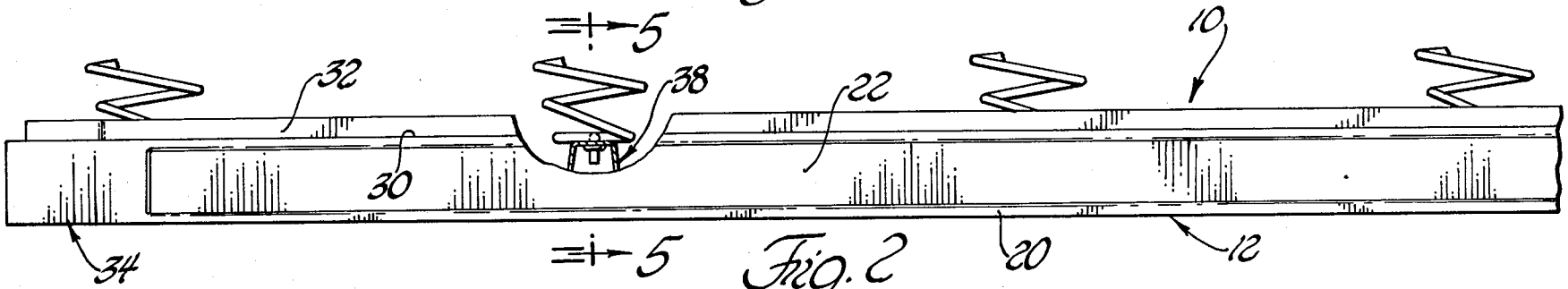
FIG. 2 is a fragementary side view partially broken away and in cross section of the assembly shown in FIG. 1.
Figure 3:
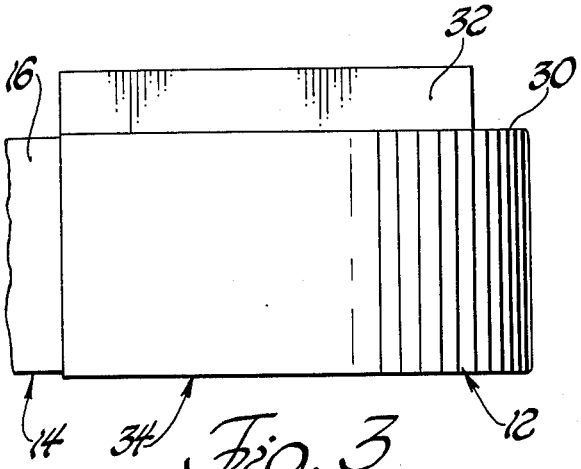
FIG. 3 is an enlarged view taken substantially along line 3—3 of FIG. 1.

The bed assembly of the instant invention includes a metal frame means generally shown at 10 in FIGS. 1 and 2. The metal frame means is of a generally rectangular configuration, although only approximately one-quarter of the assembly is shown in FIG. 1. The metal frame means 10 includes a pair of opposed side rails, one of which is generally indicated at 12. Also included are a pair of opposed end rails, one of which is generally indicated at 14. Each of the rails 12 and 14 have a hollow cross section along their respective lengths thereof. The hollow cross section of the rails 12 and 14 add substantial strength to the rails so that the rails cannot individually be twisted thereby preventing racking of the entire frame assembly where one corner can be elevated higher than the remaining corners. Such strength eliminates the need for a supporting frame and legs may be attached directly to the frame.

Figure 4:
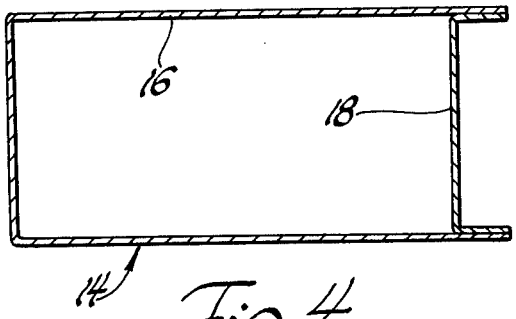
FIG. 4 is an enlarged cross-sectional view taken substantially along line 4—4 of FIG. 1.

More specifically, each of the end rails includes first and second metal members 16 and 18, as shown in FIG. 4, defining the hollow cross section. The first member 16 is U-shaped in cross section as is the second metal member 18. The second metal member 18 has shorter legs than the first U-shaped member 16 and the legs of the respective members 16 and 18 are secured together by welding so that the base portions of the U-shaped members are horizontally and/or laterally spaced apart to define the hollow cross section. The short legs of the second member 18 are disposed within the legs of the larger U-shaped member 16.

Figure 5:
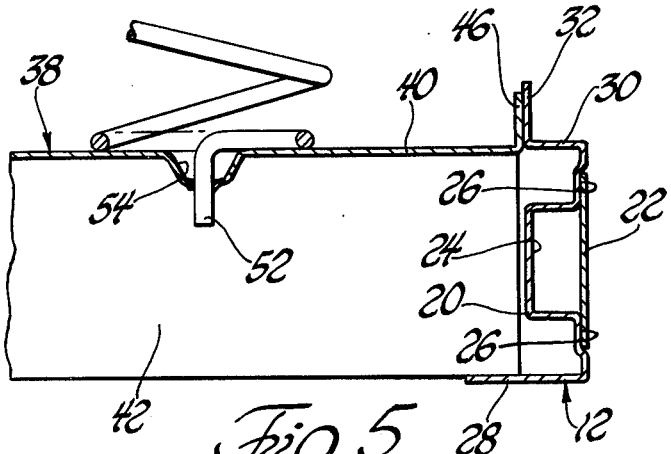
FIG. 5 is an enlarged cross-sectional view taken substantially along line 5—5 of FIG. 2.
Figure 6:
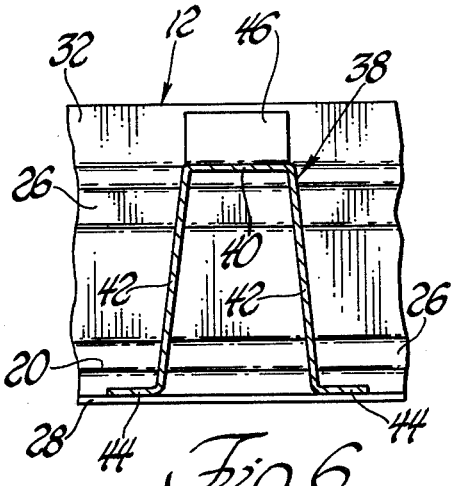
FIG. 6 is an enlarged fragmentary cross-sectional view taken substantially along line 6—6 of FIG. 1.
Figure 7:
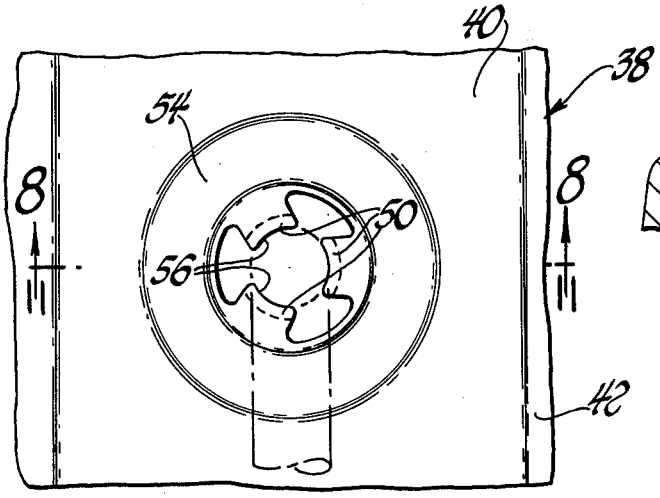
FIG. 7 is an enlarged fragmentary plan view of one of the spring retaining apertures utilized in the assembly of the subject invention.
Figure 8:
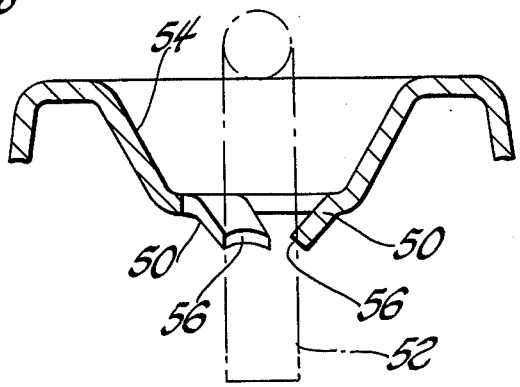
FIG. 8 is an enlarged fragmentary cross-sectional view taken substantially along line 8—8 of FIG. 7.

Each of the side rails 12 includes a pair of metal members defining the hollow cross section. One of the metal members is a channeled member 20 and the other is a closure member 22. The channeled member 20 includes a generally U-shaped channel 24, as shown in FIG. 5, extending longitudinally therealong. The closure member 22 is an elongated plate-like strip extending longitudinally along the channeled member 24 and secured thereto by welding, or the like, adjacent the channel 24 for covering the channel 24 to define the hollow cross section. The channeled member 20 is recessed at 26 along the channel 24 adjacent the top and bottom extremities thereof for receiving the closure member 22 so that the outer surface of the closure member 22 is flush with the outward face of the channeled member 20.

The outward face of the channeled member 20 extends downwardly from the lower extremity of the channel 24 to a slat support flange 28. The slat support flanges 28 are an integral part of the channeled members 20 and extend laterally inwardly toward one another and the middle of the rectangular frame assembly from the sides thereof. The slat support flanges 28 are adjacent to but spaced downwardly from the hollow cross section defined by the channel 24 and the closure member 22. The slat support flanges 28 define the bottom of the side rails 12. The front face of each channeled member 20 extends upwardly from the channel 24 thereof to a top flange 30 which extends inwardly generally parallel to the slat support flanges 28. The top flange 30 is spaced above the channel 24 of the channel member 20. Each side rail 20 also includes a vertical flange 32 extending vertically upwardly from the laterally inwardly disposed edge of the top flange 30.

The channels 24 and the closure members 22 of each of the side rails 12 terminate short of the ends thereof, as best shown in FIG. 2. The ends of the side rails 12 are arcuate, as generally indicated at 34, as viewed in plan and best illustrated in FIG. 1. The ends 34 engage the tops and bottoms of the end of the adjacent end rails 14. The top flange 32 extends through the arcuate end 34 and engages the top of the adjacent end rail 14. Similarly, the slat support flange 28 extends through the arcuate end and engages the bottom of the end of the end rail 14. The corner of the end rail 14 is cut at an angle, as shown in phantom at 36 in FIG. 1.

The assembly also includes a plurality of metal slats, each of which is generally indicated at 38. The metal slats 38 extend transversely between the side rails 12 in spaced parallel relationship to one another and to the end rails 14. Each of the slats 38 has a cross section including a base 40 with downwardly extending diverging legs 42 integral with the base and flanges 44 extending laterally from the lower ends of the respective legs 42. The end portions of the flanges 44 at the ends of the slats 38 are disposed on the slat support flanges 28 of the side rails 12. Each of the slats 38 also include a tab 46 integral therewith and extending upwardly from the base thereof at each end thereof and each of the tabs 46 engages and is secured to the vertical flange 32 of the adjacent side rail 12 by welding, or the like.

There is also included a plurality of spring retaining means disposed in the bases 40 of the slats 38 and in the end rails 14. More specifically, each spring retainer means includes an aperture with tabs 50 extending into the aperture. The tabs 50 extend downwardly at an inclined angle from the periphery of the aperture for engaging the gripping a downwardly extending tail portion 52 of a helical coiled spring. Each aperture is disposed in and surrounded by a concavity or bowl-shaped recess 54 so that each aperture is disposed in the bottom of the concavity 54 whereby the concavity 54 guides the tail 52 of the spring into each of the apertures. There are three tabs 50 extending into each of the apertures from the periphery thereof in a radial direction and each have a circular or arcuate distal end 56 for engaging the tail 52 of a helical coiled spring which has a circular circumference. The coiled springs may be quickly and easily inserted into the apertures and since the apertures are disposed in a concavity or frusto conical recess 54, the tails 52 of the springs are guided by the recesses 54 into the apertures to account for tolerances or misalignment in the fabricating equipment.

The components of the assembly may be efficiently and economically fabricated yet provide an assembly which has very high strength characteristics. The U-shaped members 16 and 18 may be rolled or stamped. The channeled members 20 of the side rails may be stamped while the closure members 22 are raw plate strips. The slats 38 may be rolled and then cut with the tabs 46 formed therein or may be stamped.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A bed assembly comprising: metal frame means of generally rectangular configuration including a pair of opposed side rails and a pair of opposed end rails, a plurality of metal slats extending transversely between said side rails in spaced parallel relationship to one another and to said end rails, a plurality of spring retainer means disposed in said slats and in said end rails, each of said spring retainer means including an aperture with tabs extending thereinto for engaging and gripping a spring inserted into said aperture, each of said apertures being disposed in a concavity for guiding a spring into each of said apertures.

2. An assembly as set forth in claim 1 including three of said tabs extending into each of said apertures.

3. A furniture assembly comprising: a coil spring with a bottom coil and an axially extending tail attached to said bottom coil, a metal support member, spring retainer means disposed in said support member, said retainer means defined by an aperture with tabs extending thereinto to engage and grip said tail of said spring inserted into said aperture, said aperture being disposed in a concavity for guiding said tail of said spring into said aperture.

4. An assembly as set forth in claim 3 wherein said concavity is a bowl and said tabs are disposed at the bottom of said bowl.

5. An assembly as set forth in claim 4 wherein said tabs are evenly spaced about the periphery of said aperture.

* * * * *